US010807117B2

(12) United States Patent
Nasman et al.

(10) Patent No.: US 10,807,117 B2
(45) Date of Patent: Oct. 20, 2020

(54) DISPENSE NOZZLE WITH A DYNAMIC LIQUID PLUG

(71) Applicant: Tokyo Electron Limited, Minato-ku, Tokyo (JP)

(72) Inventors: Ronald Nasman, Averill Park, NY (US); Bruce Altemus, Esperance, NY (US)

(73) Assignee: Tokyo Electron Limited, Tokyo (JP)

( * ) Notice: Subject to any disclaimer, the term of this patent is extended or adjusted under 35 U.S.C. 154(b) by 758 days.

(21) Appl. No.: 15/283,899

(22) Filed: Oct. 3, 2016

(65) Prior Publication Data

US 2017/0096326 A1 Apr. 6, 2017

Related U.S. Application Data

(60) Provisional application No. 62/237,355, filed on Oct. 5, 2015.

(51) Int. Cl.
*B05C 5/02* (2006.01)
*B05C 1/00* (2006.01)

(52) U.S. Cl.
CPC ..... *B05C 5/0225* (2013.01); *B05C 1/00* (2013.01); *B05C 5/02* (2013.01)

(58) Field of Classification Search
None
See application file for complete search history.

(56) References Cited

U.S. PATENT DOCUMENTS

| | | | | |
|---|---|---|---|---|
| 4,574,850 | A * | 3/1986 | Davis | G01N 35/10 141/9 |
| 4,878,601 | A | 11/1989 | Flemming et al. | |
| 4,946,100 | A | 8/1990 | Flemming et al. | |
| 5,232,664 | A | 8/1993 | Krawzak et al. | |
| 5,918,817 | A * | 7/1999 | Kanno | B05B 7/04 239/433 |
| 6,444,047 | B1 * | 9/2002 | Miyazaki | B08B 3/02 134/36 |
| 2004/0028565 | A1 * | 2/2004 | Abou-Saleh | G01N 35/1004 422/400 |
| 2005/0079106 | A1 * | 4/2005 | Baker | G01N 35/109 422/400 |
| 2007/0039866 | A1 * | 2/2007 | Schroeder | G01N 27/44769 210/265 |
| 2008/0006652 | A1 | 1/2008 | Wemmert | |
| 2008/0199596 | A1 | 8/2008 | Nakagawa | |

(Continued)

*Primary Examiner* — Jill A Warden
*Assistant Examiner* — Brittany I Fisher
(74) *Attorney, Agent, or Firm* — Wood Herron & Evans LLP

(57) ABSTRACT

Provided is a method of limiting exposure of a dispense chemical to air and meet dispense objectives in a dispense nozzle system, the method comprising: providing a sample requiring a dispense process of a dispense chemical using a dispense nozzle system; performing an opening cycle of dispense process steps to get the dispense nozzle system ready; dispensing a dispense chemical onto the sample; and performing a closing cycle of dispense process steps to prepare the nozzle system for non-use; repeating the operations of performing the opening cycle of dispense process steps, dispensing the chemical, and performing the closing cycle of dispense process steps a prescribed number of times depending on an application.

20 Claims, 6 Drawing Sheets

(56) References Cited

U.S. PATENT DOCUMENTS

| | | | | |
|---|---|---|---|---|
| 2009/0012187 | A1* | 1/2009 | Chu | A61K 9/113 516/54 |
| 2009/0131543 | A1* | 5/2009 | Weitz | A61K 9/113 516/54 |
| 2009/0226346 | A1 | 9/2009 | Miyato et al. | |
| 2010/0294048 | A1* | 11/2010 | McGuire | B01L 3/0293 73/864.34 |
| 2010/0304443 | A1* | 12/2010 | Davies | B01L 3/021 435/91.2 |
| 2012/0190033 | A1* | 7/2012 | Ness | B01L 3/021 435/6.12 |
| 2012/0195811 | A1* | 8/2012 | Nelson | G01N 35/0099 422/522 |
| 2013/0034966 | A1* | 2/2013 | Yeh | H01L 21/31111 438/704 |
| 2013/0099018 | A1* | 4/2013 | Miller | B05B 1/08 239/10 |

* cited by examiner

DISPENSE NOZZLE WITH A DYNAMIC LIQUID PLUG

BACKGROUND OF THE INVENTION

Field of the Invention

The invention relates to a system and method of limiting the exposure of the dispense liquid in a dispense system and specifically relates to a system and method of utilizing a dynamic liquid plug in a dispense nozzle system.

Description of Related Art

Some chemicals dispensed from fabrication tools quickly degrade when exposed to air. The dispense chemical is typically exposed to air at the nozzle tip from which it is dispensed. Air interacts with the surface of the dispense chemical. Interaction is aggravated by the rapid movement of the nozzle when the dispense arm is moved. Rushing air across the tip of the nozzle increases the supply of fresh air and works to remove the protective evaporative vapor layer proximate to the nozzle tip.

The interaction of the dispense chemical with air is a time dependent reaction, i.e., the longer the exposure to air, the more potential to degrade or lose some of the dispense chemical. The chemical degradation of the dispense chemical creates particles that may drastically reduce the expected effect of the dispense chemical on the substrate surface. Evaporation of the dispense chemical can also change the concentration which can negatively impact the expected result of the application of the dispense chemical. In some prior art solutions to this problem, a solvent plug is used.

However, with a solvent plug, to avoid dripping, a second suck back step where the solvent plug is pulled deeper in to leave an air space at the nozzle tip. The issue with the solvent plug approach is the matter of contamination. The tip of the nozzle needs to be dipped into the solvent bath. Particles can collect on the surface of the bath which can potentially be drawn into the nozzle or collect on the outside surface of the nozzle. These particles could then contaminate the dispense chemical. Also, the solvent plug with associated particles, needs to be cleaned out of the nozzle tip with a dummy dispense. In this case actual dispense chemical is used to clean the nozzle tip. The dispense chemical is generally very expensive, so this process creates expensive waste.

There is a need for a design of a system and method of reducing exposure of the dispense chemical that integrates the various operating variables and physical considerations of the nozzle.

SUMMARY OF THE INVENTION

Provided is a method of limiting exposure of a dispense chemical to air and meet dispense objectives in a dispense nozzle system, the method comprising: providing a sample requiring a dispense process of a dispense chemical using a dispense nozzle system; performing an opening cycle of dispense process steps to get the dispense nozzle system ready; dispensing a dispense chemical onto the sample; and performing a closing cycle of dispense process steps to prepare the nozzle system for non-use; repeating the operations of performing the opening cycle of dispense process steps, dispensing the chemical, and performing the closing cycle of dispense process steps a prescribed number of times depending on an application.

The dispense nozzle system comprises a liquid plug delivery pipe for delivering a liquid plug, a dispense delivery pipe for delivering the dispense chemical, and a sensor disposed proximate a dispense opening.

Also provided is a dispense nozzle system configured to limit exposure of a dispense chemical to air and meet dispense objectives, the dispense nozzle system comprising: a liquid plug delivery pipe for delivering a liquid plug, the liquid plug delivery pipe comprising: a liquid plug delivery portion; a liquid plug interface portion; and a dispense opening disposed on one end of the liquid plug interface portion; a liquid plug delivery inside wall on the inside of the liquid plug delivery pipe; a hydrophobic wall around the dispense opening of the liquid plug delivery pipe; a dispense delivery pipe for delivering a dispense chemical, wherein the dispense delivery pipe is disposed in the center of the liquid plug delivery pipe and extends inside the liquid plug delivery pipe up to an end of the liquid plug delivery portion; a sensor disposed proximate the dispense opening; and a controller coupled to the dispense nozzle system configured to perform sequences of operations based on instructions stored in a storage device, memory, or based on data communicated by the sensor or by external computer networks.

BRIEF DESCRIPTION OF THE DRAWINGS

A more complete appreciation of the invention and many of the attendant advantages thereof will become readily apparent with reference to the following detailed description, particularly when considered in conjunction with the accompanying drawings, in which:

FIG. 1A is an exemplary schematic of a prior art sequence of steps of operations to limit disposure of dispense chemical to air whereas

FIG. 4A is an exemplary schematic of a dispense nozzle system in a first sequence of operations to complete opening the dispense nozzle system while

FIG. 5A is an exemplary schematic of a dispense nozzle system in a first sequence of operations to complete closing the dispense nozzle system while

DETAIL DESCRIPTION

Figure 1A:
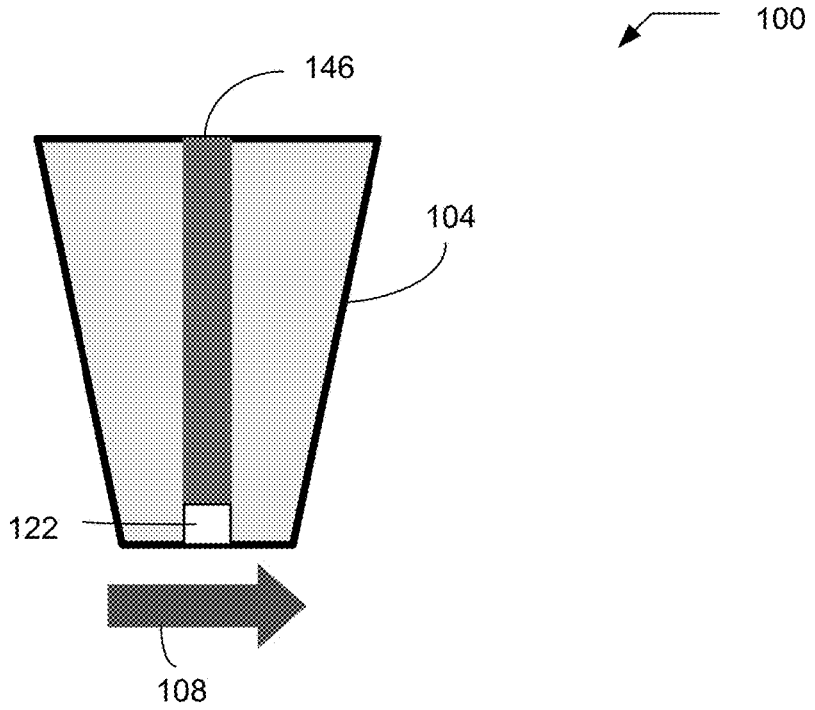
FIG. 1A Prior Art

FIG. 1A is an exemplary schematic 100 of a prior art sequence of steps of operations to limit exposure of dispense chemical to air. The typical sequence of steps in the opening, using, and closing of a dispense nozzle system in prior art starts with a first step, after dispense of the dispense chemical 146, the dispense chemical 146 is sucked back into the nozzle 104. The second step creates an air pocket 122 to limit the diffusion of the evaporated vapor from the dispense chemical 146 and to limit the replacement of air 108 at the surface. In the third step, after the suck-back operation, the nozzle 104 is moved to a tray (not shown) where air 108 moves across the nozzle tip during the movement to the tray (not shown).

Figure 1B:
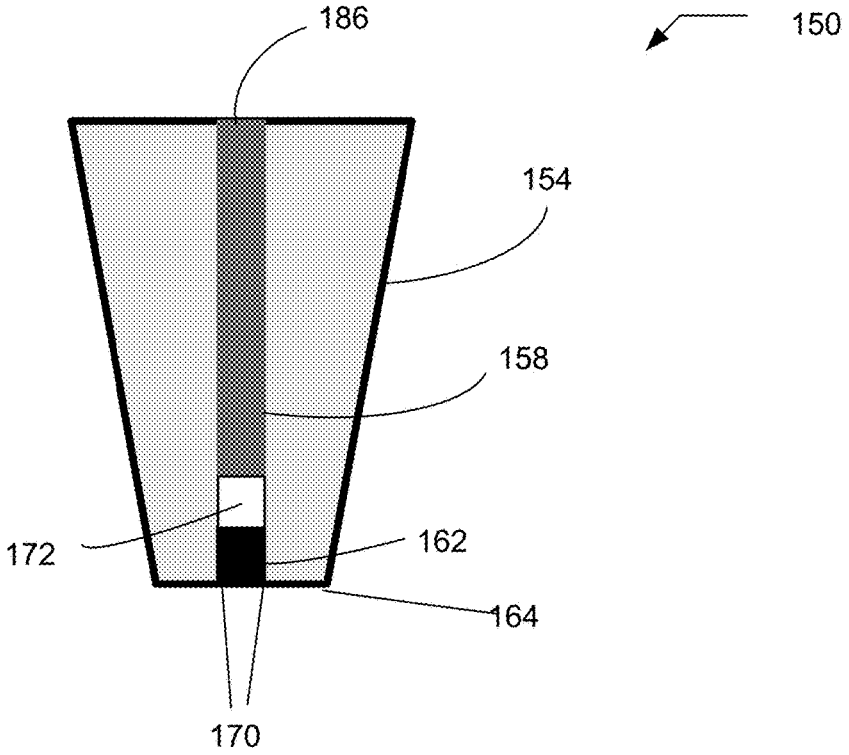
FIG. 1B Prior Art
FIG. 1B is an exemplary prior art technique of placing a plug in the dispense line to block additional exposure to air.

FIG. 1B is an exemplary schematic 150 of a prior art technique of placing a solvent plug 162 in the dispense line 158 of a nozzle 154 to block additional exposure of the dispense chemical 186 to air. In the fourth step, the nozzle tip 164 is submerged in the solvent plug in a liquid plug tray (not shown) and some of the solvent plug 162 is sucked into the nozzle tip 164 to block additional exposure of the dispense chemical 186 to air. The solvent plug 162 serves as a plug to limit further exposure of the dispense chemical 186 to air and creates an air pocket 172.

The prior art method limits the exposure of the dispense chemical, especially for extended periods where there is no dispense, however, there are some drawbacks. First, at the third step included in discussion of FIG. 1A, the dispense chemical is still left exposed to the air. Second, while the mini-environment aides in protecting the dispense chemical, it does not address the increased rate of diffusion of the dispense chemical into the air caused by the motion of the arm. Third, dipping the nozzle into a solvent plug bath increases the potential for particles to be transferred from the horizontal surface of the solvent plug bath to the surface 170 of the nozzle.

Fourth, once the nozzle is plugged with the solvent plug, the solvent plug must be purged out of the nozzle before the next dispense. The dispense chemical, which is often extremely costly, must be used to perform the purging operation. Fifth, after the nozzle is purged into the tray, it must be moved back over the substrate, wafer, or sample, repeating the exposure condition of the third step. Throughput is potentially decreased by the required movements back and forth to the tray and purging out the solvent plug.

In subsequent discussions, the "solvent plug" is replaced with a "liquid plug" to emphasize that the plug can be any suitable liquid and not limited to a solvent plug. The suitable liquid must be a) compatible with the dispense chemical, i.e., not causing any physical or chemical reaction therebetween, and b) must have a viscosity range that will avoid dripping when deployed as a liquid plug in the dispense nozzle system.

Figure 2:
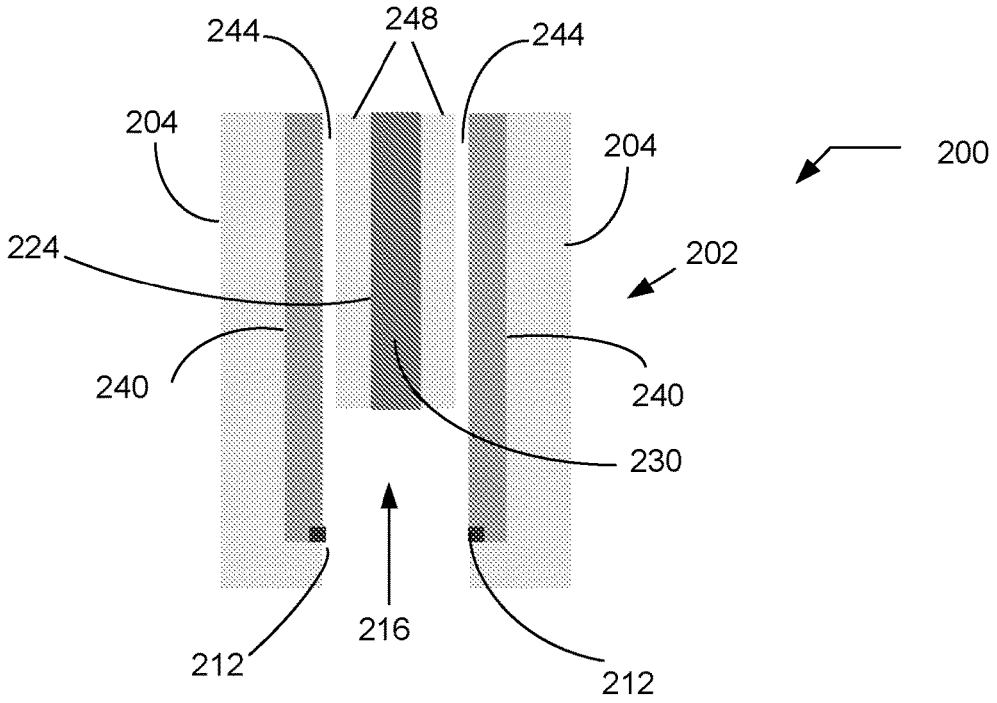
FIG. 2 is an exemplary schematic of a dispense nozzle system utilizing the concepts and principles of the present invention.

FIG. 2 is an exemplary schematic 200 of a dispense nozzle system 202 utilizing the concepts and principles of the present invention in an embodiment. The dispense nozzle system 202 comprises an outermost component which is a hydrophobic wall 204, an annular liquid plug delivery pipe 244, an annular hydrophilic wall 240, a dispense chemical delivery pipe 248, and the central port 224 which delivers the dispense chemical 230 inside the central port 224. The annular hydrophilic wall 240 can have channels or groves inside the annular hydrophilic wall 240 to facilitate suctioning the liquid plug (not shown) in or out. The hydrophobic wall 204 has a dispense opening 216 where a liquid plug bead (not shown) is formed and reformed during the steps of the dispense nozzle system opening and closing sequences. The central port 224 is also a hydrophobic wall. A sensor 212 is installed on the inside portion of the annular hydrophilic wall 240 where the sensor 212 can determine if the dispense opening 216 is open or closed.

Figure 3:
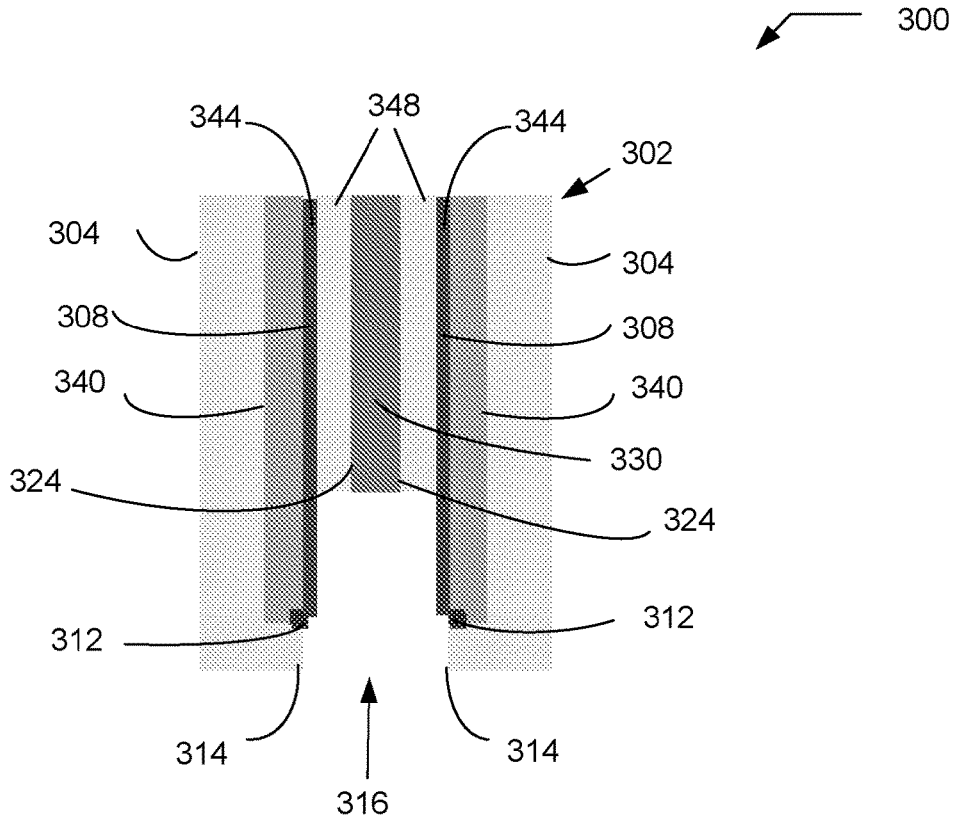
FIG. 3 is an exemplary schematic of a dispense nozzle system in an embodiment of the present invention.

FIG. 3 is an exemplary schematic 300 of a dispense nozzle system 302 in an embodiment of the present invention. The dispense nozzle system 302 comprises an outermost component which is a hydrophobic wall 304, a liquid plug delivery pipe 344, an annular hydrophilic wall 340, a dispense chemical delivery pipe 348, and the central port 324 which delivers the dispense chemical 330 inside the central port 324. The liquid plug delivery pipe 344 includes a liquid plug delivery portion 306 and a liquid plug interface portion 328. The annular hydrophilic wall 340 can have channels or groves (not shown) inside the annular hydrophilic wall 340 to facilitate suctioning the liquid plug 308 in or out. The hydrophobic wall 304 has a dispense opening 316 where a liquid plug bead (not shown) is formed and reformed during the steps of the dispense nozzle system opening and closing sequences. The central port 324 is also a hydrophobic wall. A sensor 312 is installed on the inside portion of the annular hydrophilic wall 340 where the sensor 312 can determine if the dispense opening 316 is open or closed. In the open state, the liquid plug 308 can be supplied into the liquid plug delivery pipe 344 all the way down to the sensor 312 at the bottom of the annular hydrophilic wall 340. The liquid plug 308 need not go beyond the bottom end of the annular hydrophilic wall 340 but should coat the inside completely. If the nozzle tip 314 is open, the sensor 312 senses the dispense opening 316 is open and the dispense chemical 330 can be dispensed.

Figure 4A:
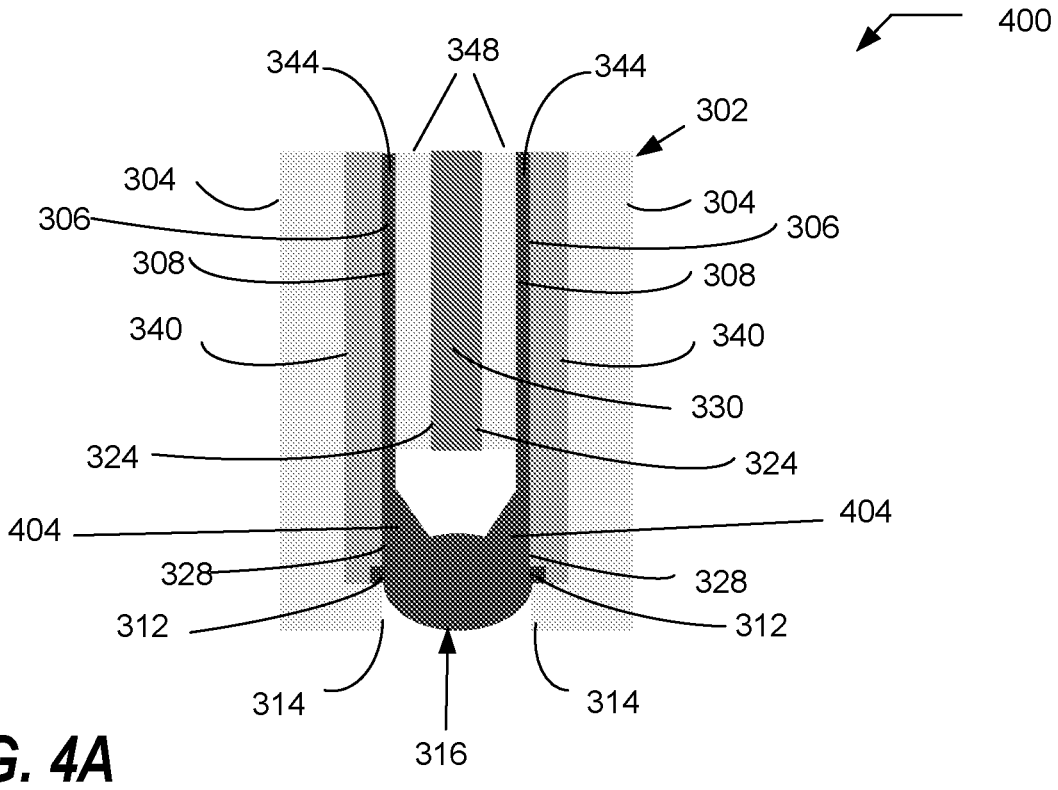

FIG. 4A is an exemplary schematic 400 of a dispense nozzle system 302 in a first sequence of operations to open the dispense nozzle system 302. The description of the components of the dispense nozzle system 302 is similar to similarly numbered components in FIG. 3 discussed above and shall not be repeated here. To open the dispense nozzle system 302, the liquid plug 308 is pulled back up through the one or more channels (not shown) in the annular hydrophilic wall 340. The size of the liquid plug bead 404 is reduced as the liquid plug 308 is removed. The liquid plug 308 is drawn back to the annular hydrophilic wall 340 from the liquid plug bead 404 using vertical channels (not shown) inside the annular hydrophilic wall 340.

Figure 4B:
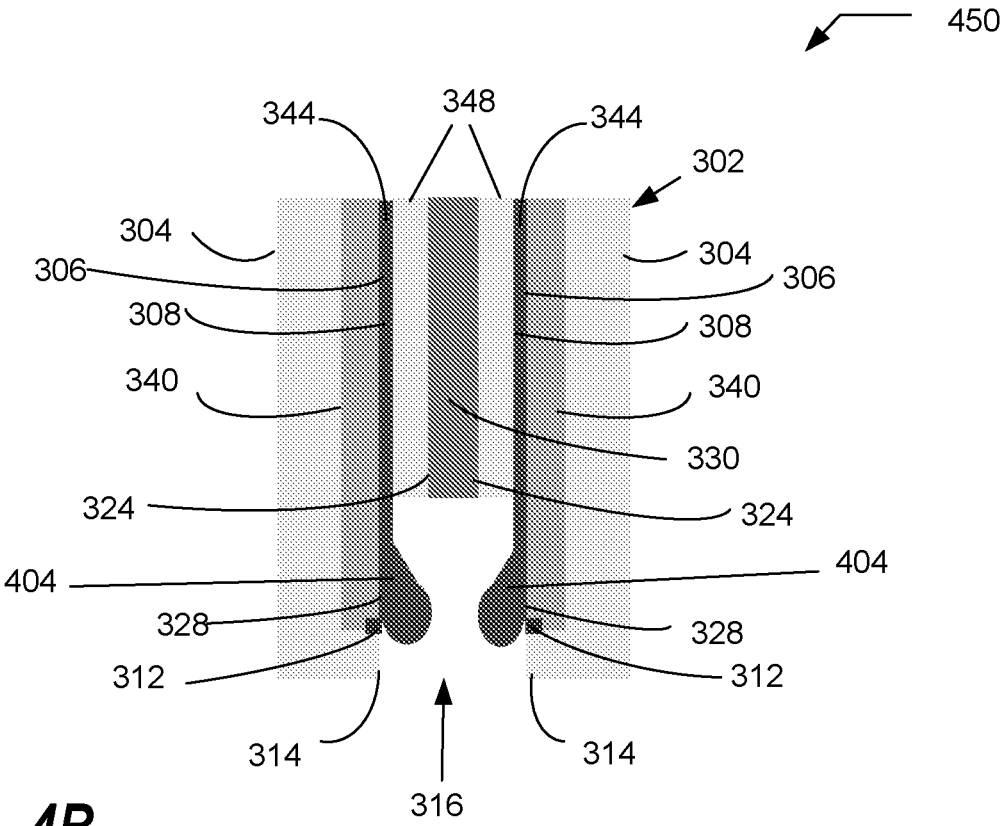
FIG. 4B is an exemplary schematic of a dispense nozzle system in a second sequence of operations to complete the opening of the dispense nozzle system.
Figure 5A:
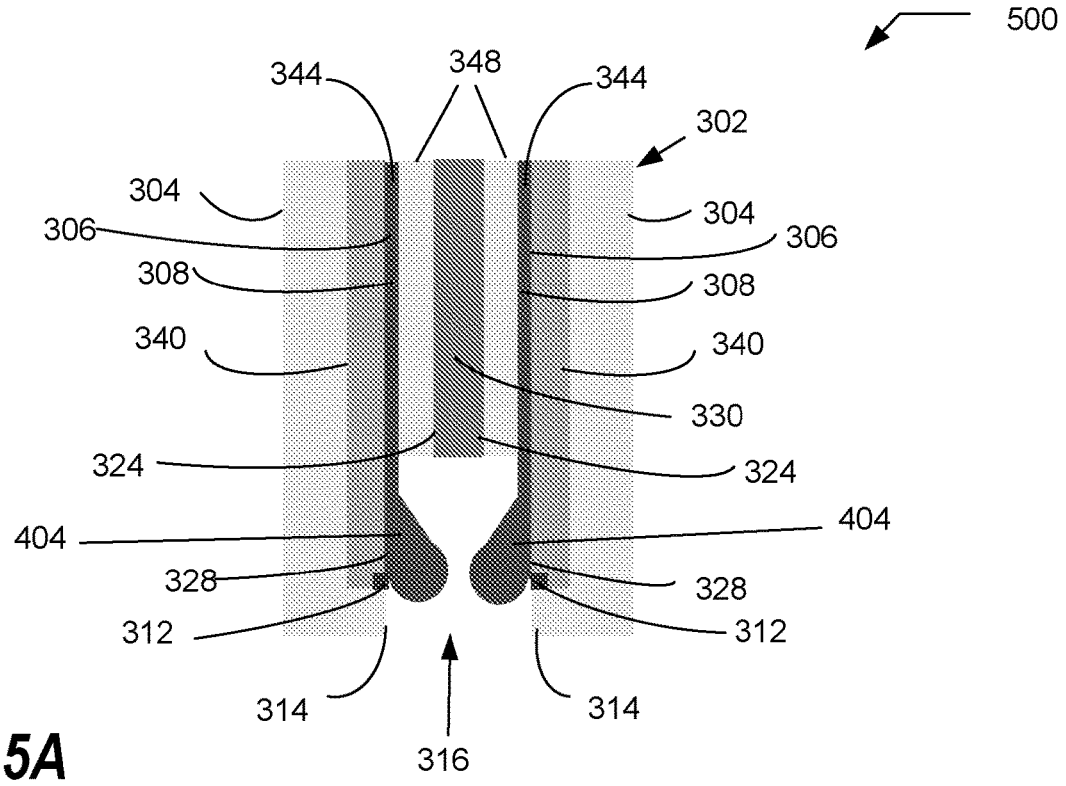

FIG. 4B is an exemplary schematic 450 of a dispense nozzle system 302 in a second sequence of operations to open the dispense nozzle system 302. The description of the components of the dispense nozzle system 302 is similar to similarly numbered components in FIG. 3 discussed above and shall not be repeated here. The liquid plug bead 404 is reduced to the point where the liquid plug bead 404 has opened but is still held to the annular hydrophilic wall 340 through surface tension. At this point, the sensor 312 detects that the dispense opening 316 is open. The process of pulling back the liquid plug 308 continues until the liquid plug bead 404 is completely eliminated, FIG. 5A is an exemplary schematic 500 of a dispense nozzle system 302 in a first sequence of operations to close the dispense nozzle system 302. The description of the components of the dispense nozzle system 302 is similar to similarly numbered components in FIG. 3 discussed above and shall not be repeated here. The first step of the closing cycle is to supply additional liquid plug 308 through the one or more channels in the annular hydrophilic wall 340. As the liquid plug 308 accumulates in the lower portion of the dispense opening 316, the liquid plug bead 404 above the nozzle tip 314 begins to close.

Figure 5B:
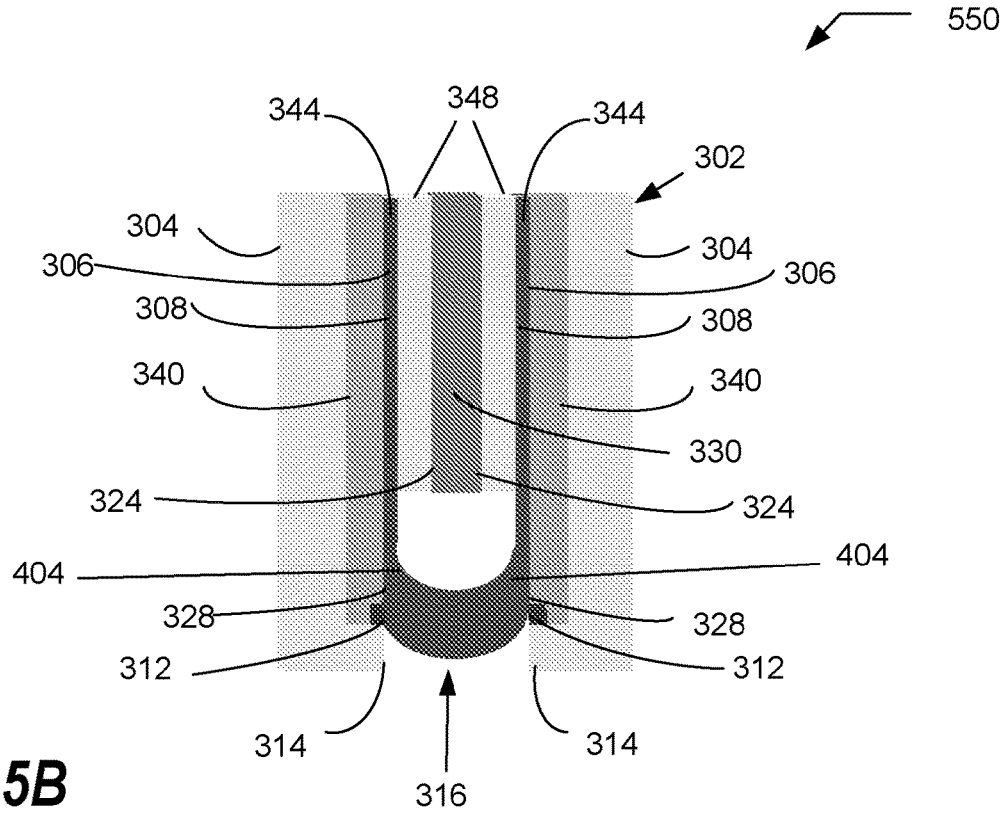
FIG. 5B is an exemplary schematic of a dispense nozzle system in a second sequence of operations to complete the closing of the dispense nozzle system.

FIG. 5B is an exemplary schematic 550 of a dispense nozzle system 302 in a second sequence of operations to close the dispense nozzle system 302. The description of the components of the dispense nozzle system 302 is similar to similarly numbered components in FIG. 3 discussed above and shall not be repeated here. Liquid plug 308 flow continues until the sensor 312 indicates the dispense opening 316 is closed. The liquid plug bead 404 finally joins together to seal off the dispense opening 316 when sufficient liquid plug 308 has been supplied. The sensor 312 indicates the dispense opening 316 is closed. The liquid plug bead 404 is held in place by capillary action. The dispense chemical 330 is protected from additional air exposure by the presence of the liquid plug bead 404.

Figure 6:
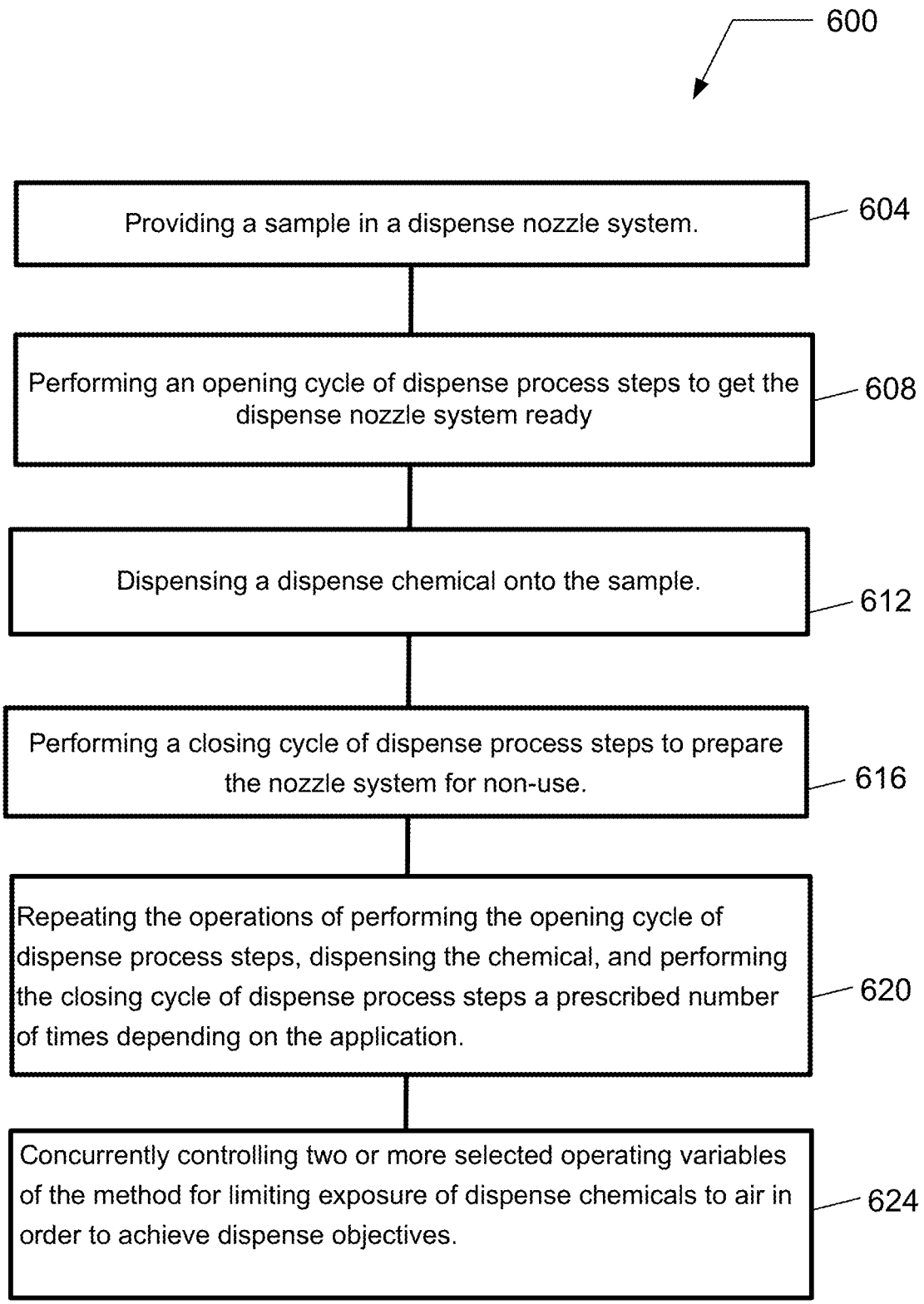
FIG. 6 is an exemplary flowchart of a method of limiting exposure of the dispense chemical to air in order to achieve processing objectives.

FIG. 6 is an exemplary flowchart 600 of a method of limiting exposure of the dispense chemical to air in order to achieve processing objectives. In operation 604, a sample in a dispense nozzle system is provided. The sample can be a substrate, memory device, wafer, flat panel display, and the like. The dispense nozzle system can be a dispense nozzle in a single substrate system. Other dispense nozzle systems in different equipment configurations can also be used. The single substrate system can be an etch, cleaning, rinsing, or a fluid treatment process.

In operation 608, an opening cycle of dispense process steps are performed to get the dispense nozzle system ready. The opening cycle of dispense process steps can include: 1) forming a liquid plug bead by pulling the liquid plug back up using the one or more channels or grooves in an annular hydrophilic wall; 2) reducing the size of the liquid plug bead as the liquid plug is removed; 3) pulling the liquid plug back up using the one or more channels until the liquid plug bead is completely eliminated; and 4) sensing using the sensor that the dispense opening is open. At this point, the dispense nozzle system is ready to apply the dispense chemical to the sample.

In operation 612, the dispense chemical is dispensed onto the sample. As indicated above, the dispense chemical can be an etch, rinsing, cleaning chemical or the like. In operation 616, a closing cycle of dispense process steps is performed to prepare the nozzle system for non-use, comprising of the following steps: (1) supplying the liquid plug through the one or more channels of the liquid plug inside wall; (2) forming a liquid plug bead around the dispense opening; (3) increasing the size of the liquid plug bead until all portions of the liquid plug bead join together to seal off the dispense opening; and (4) sensing, using the sensor, that the dispense opening is closed.

In operation 620, the operations of performing the opening cycle of dispense process steps, dispensing the chemical, and performing the closing cycle of dispense process steps are repeated a prescribed number of times depending on the application. An application may use more than one chemical in a series of chemical dispensing operations. For example, an etch step may use a first chemical or chemicals, and a subsequent overetch step may use a different chemical or chemicals. In another example of a wet etch process, the first dispense chemical can be an acid solution and the second dispense chemical can be an oxidizer solution.

In operation 624, one or more selected operating variables of the method for limiting exposure of dispense chemicals to air are concurrently controlled in order to achieve dispense objectives. Operating variables can include the dispense chemical flow rate, liquid plug temperature, ambient air temperature, suck-back flowrate of the liquid plug, liquid plug viscosity, and the like. For example, suck-back flowrate of the liquid plug may be selected as the one or more selected operating variable that must be in a specified range in order to meet an output objective such as number of substrates processed per hour. A lower flowrate than specified may result in missing the output objective of substrates processed per hour. Another example may include a range of the liquid plug viscosity in order to prevent dripping of the liquid plug.

Figure 7:
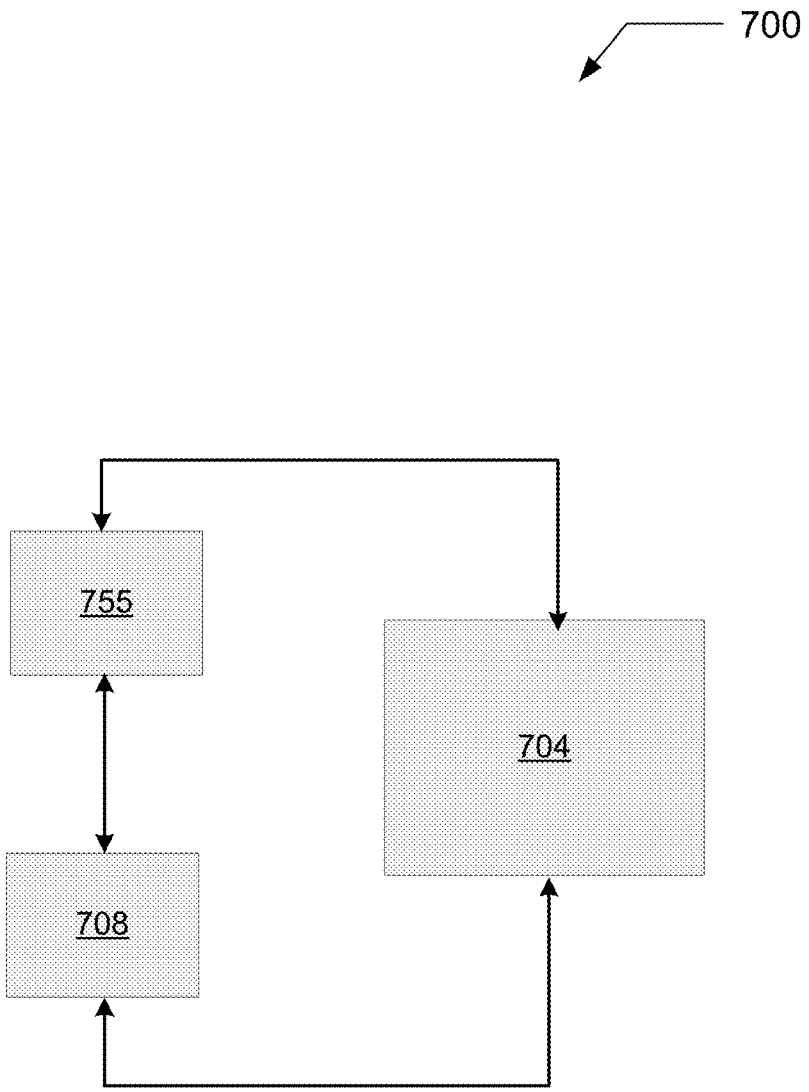
FIG. 7 depicts an exemplary processing system to perform limiting the exposure of the dispense chemical to air in one embodiment of the present invention.

FIG. 7 depicts an exemplary schematic 700 of a dispense nozzle system 704 to perform limiting the exposure of the dispense chemical to air in one embodiment of the present invention. The dispense nozzle system 704 is coupled to a controller 755 and to a fabrication system 708. The controller 755 can comprise a microprocessor, memory, and a digital I/O port capable of generating control voltages sufficient to communicate and activate inputs to the dispense nozzle system 704 and to the fabrication system 708 as well as monitor outputs from fabrication system 708. Moreover, controller 755 can be coupled to and can exchange information with dispense nozzle system 704 and subsystems of the fabrication system 708. For example, a program stored in the memory can be utilized to activate the inputs to the aforementioned subsystems of fabrication system 708 and of the dispense nozzle system 704 according to a process recipe in order to perform a dispense process on a substrate.

Depending on the applications, additional devices such as sensors or metrology devices can be coupled to the dispense nozzle system 704 and to the fabrication system 708 and the controller 755 can collect real time data and use such real time data to concurrently control one or more selected operating variables in two or more steps involving dispense chemical flow rate, liquid plug temperature, ambient air temperature, suck-back flowrate of the liquid plug, liquid plug viscosity, and the like in order to achieve dispense objectives.

Specifically, the controller 755 coupled to the dispense nozzle system 704 can be configured to perform sequences of operations based on instructions stored in a storage device, memory, or based on data communicated by the sensor or by external computer networks. One or more sensors can be programmed to detect absence of the liquid plug bead and in conjunction with controller, proceeds to recreating the liquid plug bead. The fabrication system 708 can be an etch, cleaning, rinsing, tract, or fluid treatment semiconductor fabrication system. Further, the controller can be configured to utilize selected operating variables which are concurrently controlled to achieve the dispense objectives, the dispense objectives comprising cost of ownership, throughput samples per hour, reduced particle contamination, cleanliness of the dispense nozzle system, and reduced usage of the dispense chemical.

Additional advantages and modifications will readily appear to those skilled in the art. The invention in its broader aspects is therefore not limited to the specific details, representative apparatus and method, and illustrative examples shown and described. Accordingly, departures may be made from such details without departing from the scope of the general inventive concept.

What is claimed is:

1. A method of limiting exposure of a dispense chemical to air and meeting dispense objectives in a dispense nozzle system, the method comprising:

providing a substrate requiring use of a dispense chemical using a dispense nozzle system in a semiconductor fabrication system;

performing an opening cycle of dispense process steps to get the dispense nozzle system ready to dispense a dispense chemical, wherein the opening cycle includes removing a liquid plug from a dispense opening in the dispense nozzle system;

dispensing the dispense chemical onto the substrate through the dispense opening; and performing a closing cycle of dispense process steps to prepare the nozzle system for non-use, wherein the closing cycle includes forming a new liquid plug to seal the dispense opening;

repeating the operations of performing the opening cycle of dispense process steps, dispensing the dispense chemical, and performing the closing cycle of dispense process steps at least once.

2. The method of claim 1 wherein the dispense nozzle system comprises:

a component having a hydrophobic wall defining the dispensing opening;

a liquid plug delivery pipe within the hydrophobic wall and including an annular hydrophilic wall for delivering the liquid plug, wherein the annular hydrophilic wall comprises:

a liquid plug delivery portion; and a liquid plug interface portion proximate the dispensing opening;

a dispense chemical delivery pipe for delivering the dispense chemical, wherein the dispense chemical delivery pipe is disposed in a center of the liquid plug delivery pipe and extends toward the dispense opening to a distance that is less than a height of the annular hydrophilic wall to form a pocket defined by the dispense chemical delivery pipe and the annular hydrophilic wall;

a sensor disposed proximate the dispense opening; and a controller coupled to the dispense nozzle system configured to perform sequences of operations based on instructions stored in a storage device, memory, or based on data communicated by the sensor or by external computer networks;

wherein the annular hydrophilic wall has one or more channels along a length of the annular hydrophilic wall.

3. The method of claim 2 wherein the opening cycle of dispense process steps comprises:

removing the liquid plug bead from the pocket by pulling the liquid plug toward the liquid plug delivery portion using the one or more channels; and sensing using the sensor that the dispense opening is open.

4. The method of claim 3 wherein performing the closing cycle of dispense process steps comprises:

supplying the liquid plug through the one or more channels of the annular hydrophilic wall;

forming the liquid plug bead in the pocket;

increasing a size of the liquid plug bead until all portions of the liquid plug bead join together forming the new liquid plug to seal off the dispense opening; and sensing using the sensor that the dispense opening is closed.

5. The method of claim 4 wherein the dispense nozzle system is opened immediately before dispensing and closed immediately after dispensing.

6. The method of claim 4 wherein throughput of the dispense nozzle system is increased due to elimination of time to purge the liquid plug out of the dispense nozzle system.

7. The method of claim 4 wherein cross contamination of the liquid plug and the dispense chemical are minimized due to the liquid plug and the dispense chemical being kept separate.

8. The method of claim 4 wherein particles of the liquid plug are not transferred to a nozzle tip because the nozzle tip is not dipped in the liquid plug.

9. The method of claim 4 wherein particles of the dispense chemical are not transferred to a nozzle tip because the nozzle tip is not dipped in the dispense chemical.

10. The method of claim 4 wherein the sensor is programmed to detect absence of the liquid plug bead and in conjunction with the controller, proceeds to recreate the liquid plug bead.

11. The method of claim 4 wherein usage of the dispense chemical is minimized due to reduction of exposure of the dispense chemical to air.

12. The method of claim 4 wherein the dispense nozzle system is designed to control selected process operating variables in order to meet the dispense objectives.

13. The method of claim 4 wherein the liquid plug delivery pipe functions as a hydrophilic wall and the dispense delivery pipe functions as a hydrophobic wall.

14. The method of claim 4 wherein cost of ownership of the dispense nozzle system is less due to less evaporation of the dispense chemical.

15. The method of claim 4 wherein if the sensor senses an undesired open state of the dispense nozzle system, the sensor is programmed to recreate a closed state.

16. The method of claim 4 wherein throughput of the dispense nozzle system is increased due to elimination of time moving an arm holding a nozzle to liquid plug trays or other devices required for opening and closing of the dispense opening.

17. The method of claim 4 wherein:

the liquid plug and the dispense chemical are purged as needed to maintain cleanliness of the dispense nozzle system; or the dispense chemical is protected even while an arm holding the dispense nozzle system is in motion; or cross contamination of the liquid plug and the dispense chemical is minimized due to the liquid plug and dispense chemical being kept separate.

18. The method of claim 4 where the selected operating variables are concurrently controlled to achieve the dispense objectives, the dispense objectives comprising cost of ownership, throughput samples per hour, reduced particle contamination, and reduced usage of the dispense chemical.

19. The method of claim 1 wherein the dispense nozzle system is part of an etch, cleaning, rinsing, tract, or fluid treatment semiconductor fabrication system.

20. A method of limiting exposure of a dispense chemical to air and meeting dispense objectives in a dispense nozzle system, the method comprising:

providing a substrate requiring use of a dispense chemical using a dispense nozzle system in a semiconductor fabrication system, wherein the dispense nozzle system comprises:

a component having a hydrophobic wall defining a dispensing opening; a liquid plug delivery pipe within the hydrophobic wall and including an annular hydrophilic wall for delivering a liquid plug, wherein the annular hydrophilic wall comprises:

a liquid plug delivery portion; and a liquid plug interface portion proximate the dispensing opening;

a dispense chemical delivery pipe for delivering the dispense chemical, wherein the dispense chemical delivery pipe is disposed in a center of the liquid plug delivery pipe and extends toward the dispense opening to a distance that is less than a height of the annular hydrophilic wall to form a pocket defined by the dispense chemical delivery pipe and the annular hydrophilic wall;

a sensor disposed proximate the dispense opening; and a controller coupled to the dispense nozzle system configured to perform sequences of operations based on instructions stored in a storage device, memory, or based on data communicated by the sensor or by external computer networks;

wherein the annular hydrophilic wall has one or more channels along a length of the annular hydrophilic wall;

performing an opening cycle of dispense process steps to get the dispense nozzle system ready to dispense a dispense chemical;

dispensing the dispense chemical onto the substrate; and performing a closing cycle of dispense process steps to prepare the nozzle system for non-use;

repeating the operations of performing the opening cycle of dispense process steps, dispensing the dispense chemical, and performing the closing cycle of dispense process steps at least once.

* * * * *